United States Patent [19]

Boll

[11] Patent Number: 4,894,869

[45] Date of Patent: Jan. 23, 1990

[54] PROTECTIVE UNDER GARMENT

[76] Inventor: Edward J. Boll, P.O. Box 277, Ottiville Rd., Niverville, N.Y. 12130

[21] Appl. No.: 215,079

[22] Filed: Jul. 5, 1988

[51] Int. Cl.[4] ..... A41B 9/00

[52] U.S. Cl. ..... 2/400; 2/46; 2/404; 2/408

[58] Field of Search ..... 2/400, 402, 404, 408, 2/407, 401, 46, 227, 238, 48

[56] References Cited

U.S. PATENT DOCUMENTS

| | | | |
|---|---|---|---|
| 897,445 | 9/1908 | Bartrum . | |
| 971,680 | 10/1910 | Kline | 2/46 |
| 1,406,225 | 2/1922 | Rathsmill | 2/46 |
| 1,711,611 | 5/1929 | Mock . | |
| 2,505,256 | 4/1950 | Goldstein | 2/404 X |
| 2,565,739 | 8/1951 | Pointen . | |
| 2,621,327 | 12/1952 | Amoroso | 2/46 X |
| 3,085,248 | 4/1963 | Benson . | |
| 3,708,799 | 1/1973 | Smithdeal | 2/46 |
| 4,229,835 | 10/1980 | Shaw . | |
| 4,459,703 | 7/1984 | Kosmas et al. . | |

FOREIGN PATENT DOCUMENTS

| | | | |
|---|---|---|---|
| 2476987 | 9/1981 | France | 2/46 |
| 1935908 | 8/1907 | United Kingdom | 2/46 |
| 368573 | 3/1932 | United Kingdom | 2/404 |

*Primary Examiner*—H. Hampton Hunter

*Attorney, Agent, or Firm*—Schmeiser, Morelle & Watts

[57] ABSTRACT

A protective under garment having a waterproof outer surface and an absorptive inner surface. The garment has a waistband and leg bands for securing the garment about the user. The garment is open faced and leg bands secured to the crotch of the garment hold the garment in place to form a comfortable and convenient protective shield.

3 Claims, 2 Drawing Sheets

PROTECTIVE UNDER GARMENT

FIELD OF THE INVENTION

This invention generally relates to the field of clothing. More specifically, this invention is an open faced water proof undergarment which is secured to the user by waist and leg bands to provide insulation and dryness.

BACKGROUND OF THE INVENTION

One of the main difficulties or annoyances encountered by those who partake of outdoor activities is the ability to remain warm and dry. This is especially true where such activities result in either sitting on the ground or otherwise coming into contact with cold moist surfaces for any extended period of time. A most pertinent example is hunting where one generally selects a location of anticipated animal activity and then conceals himself, often sitting on the ground, logs, rocks or the like. At best, such a seat is generally damp and more often then not it is either wet or covered with snow. This problem is exacerbated when one considers the fact that a good portion of the hunting season is during a time when weather is generally inclement.

Obviously, once a hunters clothing becomes damp and cold the entire experience is far less enjoyable. Furthermore, even limited exposure to such conditions can precipitate illnesses such as colds and the like. This seems to be especially true where the damp and cold area include the hunters lower back. I have also observed that when one becomes wet or cold, irritability generally follows. This leads to a reduction in concentration and caution as actions hurried and abruptness replaces the more determined and cautious approach which is prevalent when a person is warm, dry and generally comfortable.

In order to assist the hunter to endure the elements a variety of items are readily available. Myriad forms of rain gear such as ponchos, rain coats, water proof trousers and the like are all sold in order to help the hunter reman warm and dry. However, while such items would seem sufficient to meet the hunters needs, experience reveals a variety of shortcomings with the items presently available.

These items fall into one of several categories including being too bulky to carry, subject to breaking, too restrictive of the hunters movements, not sufficiently versatile to warm and protect where and when it is needed yet not cause general overheating and discomfort.

For example, to be effective, poncho or rain coat must extend down below the wearers seat. This however can be very cumbersome, especially if the hunter must move quickly or needs to hike a significant distance to the hunting spot. Furthermore, this extra clothing may not allow for sufficient ventilation and is not versatile enough to meet changes in weather conditions. Thus, the hunter finds himself in a situation where he needs to wear the rain coat for protection but warming weather conditions may make the item uncomfortable. The hunter then generally removes the coat while attempting to remain seated on it in order to maintain protection. Of course, such an approach is extremely undesirable as a hunter certainly does not want to worry about his rain coat if it becomes necessary to move quickly, and sometimes quietly, from his hiding position.

Other items such as inflatable and collapsible seats attempt to solve this same difficulty and when used can be quite comfortable. However, these items are also too cumbersome for hiking and due to rugged use often become broken or punctured.

Items such as thermal underwear and the like are not waterproof and even if one were to wear a waterproof trouser they would in most cases be too hot and restrictive. Further, if worn as undergarments these types of clothing tend to ride up on the user thereby causing discomfort.

Patents such as Kosmas et al, U.S. Pat. No. 4,459,703 and Mock, U.S. Pat. No. 1,711,611 suggest the use of free hanging seat protectors which are strapped to the waist and extends over the buttocks. Such a product, if placed inside the pants will become displaced thereby reducing protection and causing discomfort. Furthermore, these items do not sufficiently protect the inside of the legs or the crotch area and therefore dampening of the outer garments eventually migrates from these areas once again causing discomfort. When worn outside the pants the item is not only unsightly but will still fail to stay in place during use especially if the user needs to move from one location to another. Furthermore, those parts of clothing which are not protected will again become wet and such wetness will migrate beneath the protector thereby circumventing its purpose. Clearly, placing such an item on the outside of the clothing may be suitable as explained in the Komas patent where the user is simply sitting on a cold but relatively dry surface for a relatively short period of time. However, such items are not sufficient for extended exposure for the reasons set forth above.

SUMMARY OF THE INVENTION

The subject invention is an open-faced garment. The protective portion of the invention has a water proof outer surface and an absorbent inner surface. If desired, padding may be secured between the two layers for comfort and additional insulation. The item is worn as one would wear a pair of shorts, the top edge of the protective seat portion of the garment attaching to the waist band but extending only halfway around said waist band. Thus the protective area extends from the middle of one side of the waistband across the back to the middle of the other side of the waistband. The seat extends downward fitting over the buttocks and the upper portion of the leg where two leg bands attach to the seat and the crotch portion of the item. Thus, the garment does not ride up on the user and furthermore, by extending half way around the user and having a crotch segment covering the inner upper parts of the thighs the garment sufficient protects the wearer from cold and moisture while the open faced aspect prevents overheating and is convenient to wear and does not block the use of a pants Zipper.

While one of its most pertinent uses of this invention is for hunters it should be appreciated that similar characteristics may be advantageous for other purposes. Furthermore, additional advantages of the subject invention may be learned by study of the subject disclosure and use of the item.

DETAILED DESCRIPTION OF THE INVENTION

Figure 2:
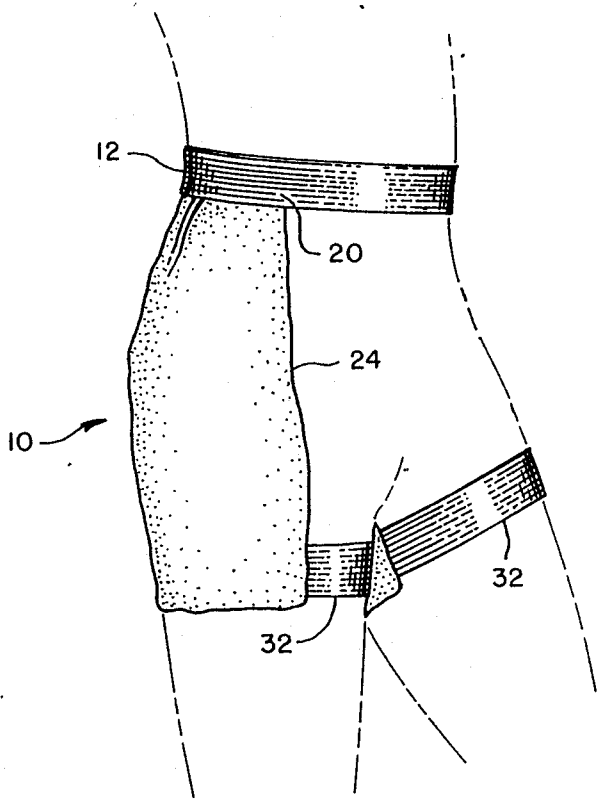
FIG. 2 is an elevational view of the invention shown from the front.
Figure 1:
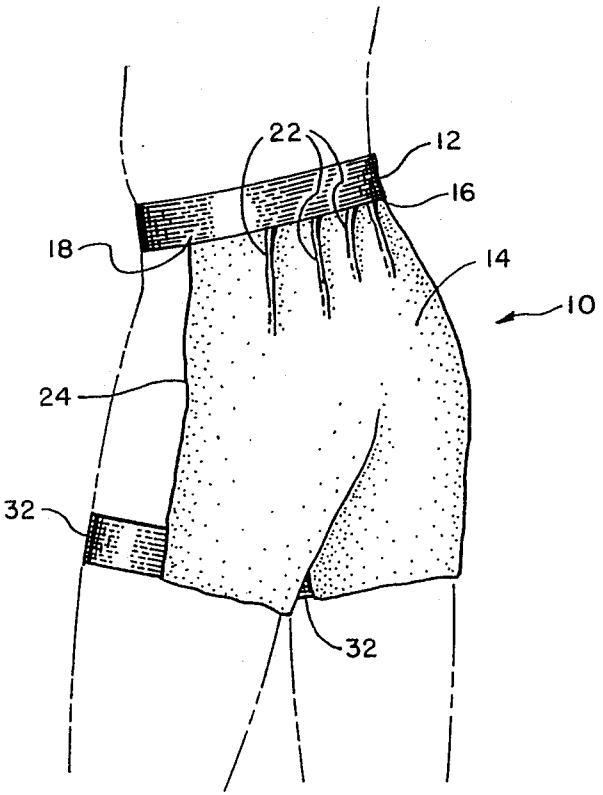
FIG. 1 is an elevational view of the invention shown from the rear.

FIG. 1 shows the subject invention being worn, disclosing the protective undergarment generally designated as 10. The garment has a waist band 12 which is preferably made of elastic. Secured to the waistband is the seat portion 14 of the undergarment 10. The seat portion is secured to only half of the waistband with the top edge 16 of the seat portion secured to the waistband and extending from the middle of one side of the waistband designated as 18 across the back to the middle of the other side of the waistband designated as 20. The top edge 16 is gathered, as shown at 22, at the attachment to the waist band so as to form a slight balloon for the main body of the seat portion which covers the users buttocks. As shown in FIGS. 1 and 2 the outer margins 24 of the seat portion extend downward from the waistband along the side of the thigh to an area on the thigh in substantial alignment with the crotch 26 of the garment 10.

Figure 4:
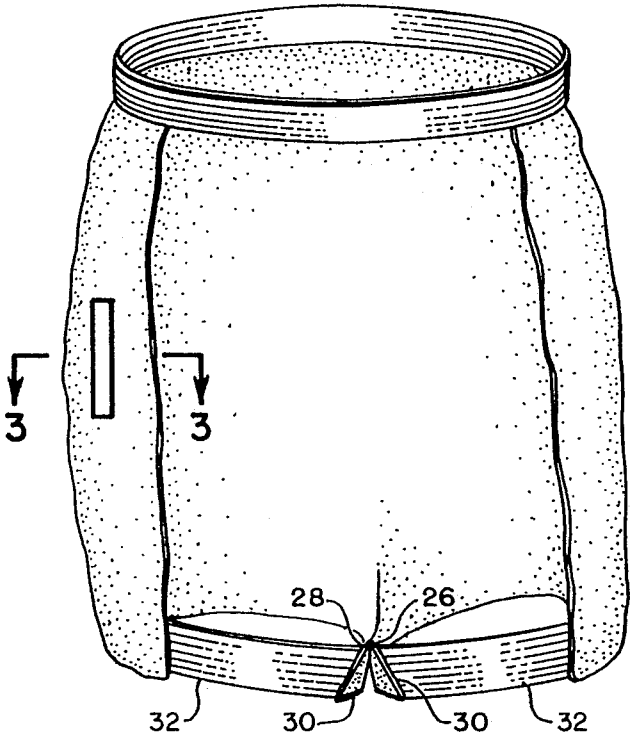
FIG. 4 is a front elevational view of the invention.

As shown in FIG. 4 at the center bottom portion of the seat is the crotch 26. The crotch 26 may be defined as an upside-down "U" where in one embodiment a center line 28 extends outwardly from the seat, said center line being formed by the attachment of side panels 30. The rearward edge of the side panels are secured to the seat portion and the front edge of the side panels are secured to the leg bands 32. The leg bands which are made of elastic attach on the other side to the side margin of the undergarment. All elastic items are preferably of the type which expand horizontally but not vertically which further help to avoid any movement while the garment is being worn. Thus, the leg bands hold the crotch section in place thereby preventing moisture from contacting the user in that area and also creating a secure fit.

Figure 3:
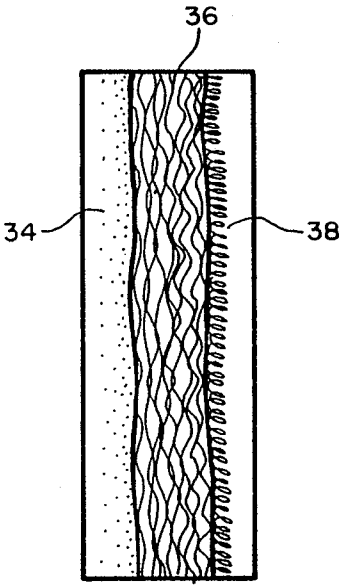
FIG. 3 is a cross sectional view taken along lines 3—3 of FIG. 4.

FIG. 3 is a cross sectional view showing the outer surface 34 which is waterproof. In my preferred embodiment the garment is made of terry cloth with the outer surface being laminated to provide the waterproofing. If desired, padding 36 may be secured to the outer surface 34 and to the inner surface 38 to provide additional insulation and cushioning.

In operation, the user simply steps into the garment as he would a normal pair of shorts. However, the garment only partially encloses the individual, having a seat portion which covers the rear and half of the sides of the individual while the front portion is opened giving an open-faced effect. The leg bands 32 secure around the upper portion of the users thighs and serve to hold the crotch 26 in place to provide proper protection. The user then simply puts on trousers and proceeds as he normally would.

While the above describes the preferred embodiment of the invention it should be appreciated that variations may be made without departing from the intent of the subject invention as set forth in the appended claims.

I claim:

1. A protective undergarment comprising:

a waistband;

a seat portion having a top margin secured to and extending along a segment of said waistband, said seat portion also having free side margins extending downwardly from the waistband forming an open faced garment;

a crotch portion at the center, bottom of the seat, said crotch portion having two side panels secured to each other along their top edges, forming a center line, said center line extending outwardly from the seat, said side panels extending down on either side of the garment, the rearward edge of each of said side panels secured to the seat; and leg bands secured at one end toward the side margins of the seat and at the other end each leg band secured substantially along the entire forward edge of a side panel.

2. The invention of claim 1 wherein the outer surface of the seat portion is waterproof and the inner surface is absorptive.

3. The invention of claim 2 further comprising insulating padding secured between said inner and outer surfaces.

* * * * *